US005868842A

United States Patent [19]

Chung

[11] Patent Number: 5,868,842

[45] Date of Patent: Feb. 9, 1999

[54] AUTOMATIC GLUE SPRAYING MACHINE FOR SCREWS

[75] Inventor: Fa-Chih Chung, Miao-Li Hsien, Taiwan

[73] Assignee: Jiuh Yih Hardware Co., Ltd., Miao-Li Hsien, Taiwan

[21] Appl. No.: 795,662

[22] Filed: Feb. 6, 1997

[51] Int. Cl.[6] ..... B05B 7/06; B05C 1/00

[52] U.S. Cl. ..... 118/500; 118/315; 118/230

[58] Field of Search ..... 198/691, 459.2, 198/41; 221/200, 204; 118/308, 319, 312, 620, 641, 500, 313, 232, 230, 255, 503, 315, 320; 427/421, 424; 156/538, 567

[56] References Cited

U.S. PATENT DOCUMENTS

| | | | |
|---|---|---|---|
| 3,831,736 | 8/1974 | Barnes | 118/324 |
| 4,100,882 | 7/1978 | Duffy et al. | 118/308 |
| 4,155,327 | 5/1979 | Alexander et al. | 118/319 |
| 4,366,190 | 12/1982 | Rodden et al. | 118/308 |
| 4,775,555 | 10/1988 | Duffy | 118/308 |
| 5,141,771 | 8/1992 | DiMaio et al. | 118/308 |
| 5,476,689 | 12/1995 | Stone et al. | 118/623 |
| 5,587,018 | 12/1996 | Chung | 118/324 |

*Primary Examiner*—David A. Simmons
*Assistant Examiner*—Calvin Padgett
*Attorney, Agent, or Firm*—Bacon & Thomas, PLLC

[57] ABSTRACT

An automatic glue spraying machine for screws, including a screw vibrator, a conveying device, a large asbestos board, a small asbestos board, a high frequency heater, an exhaustion radiating device, two glue sprayers, a glue powder vibrator, a glue powder recovering device, a resilient stopper plate, an arch inclined board and a conveying belt. The screws to be glued are placed in the screw vibrator, whereby the screw vibrator vibrates to upward move the screws along an inner spiral slope face of the screw vibrator into a guide way. The guide way serves to guide and advance the screws to a rotary disk of the conveying device with the screws hung on the peripheral notches thereof. When conveyed, inner retaining arch edges of the large and small asbestos boards serving to keep the screws attached to the periphery of the rotary disk. After the screws are heated by the high frequency heater to a predetermined temperature, the glue powder is evenly sprayed out from the nozzles of the glue sprayers to a predetermined section of the screw and the high temperature of the screw itself instantaneously melt the glue powder to adhere to the screw.

3 Claims, 5 Drawing Sheets

AUTOMATIC GLUE SPRAYING MACHINE FOR SCREWS

BACKGROUND OF THE INVENTION

The present invention relates to an automatic glue spraying machine for screws, in which a rotary disk of the conveying device is formed with peripheral notches serving to space the screws from each other at equal intervals and stably convey the screws without jamming or swinging thereof. A telescopic tube body supporting the glue sprayers is vertically adjustable according to the length of position of the screws and the rotary disk of the conveying device is replaceable with another rotary disk with peripheral notches suitable for the diameter of the screws so that the glue spraying machine is applicable to various diameters and lengths of screws. During glue spraying operation, a store is created in the air chamber of the main body of the sprayer to previously evenly stir the glue powder and then evenly spray out the glue powder to the desired section of the screw. Therefore, a better glue spraying operation is achieved.

FIGS. 1 and 2 show a conventional glue spraying machine for screws and the glue spraying operation thereof. The conveying device 10 of the conventional glue spraying machine is composed of two rollers 11 and two parallel conveying belts 12 drivingly wound on the rollers 11. A high frequency heater 28 is disposed between the rollers 11 and two glue nozzles 30 are disposed at a rear section of the conveying device 10. A glue recovering sucker 31 is disposed opposite to the glue sprayers 30. In use, a vibrator vibrates to upward move the screws along a spiral slope face thereof into the space between the parallel conveying belts 12 with the head of the screw hung on the upper sides of the conveying belts 12, while the stem of the screw suspended therefrom. When the screws are heated through the high frequency heater 20, the screws are heated thereby to a desired high temperature. Thereafter, the screws are further conveyed forward through the glue nozzles 30. At this time, the glue powder is sprayed out from the glue nozzles 30 toward the predetermined position of the screw. The high temperature of the screw itself then instantaneously melts the glue powder to adhere to the screw. After the glue spraying operation is completed, the excessive glue powder is recovered by the recovering sucker 31. The glued screws are further conveyed by the parallel conveying belts 12 to fall onto a large conveying belt to be conveyed and cooled.

Several shortcomings exist in the above arrangements as follows:

1. The parallel conveying belts 12 fail to space the screws from each other at equal intervals. Moreover, when revolving, the conveying belts 12 tend to shock. Therefore, when conveyed, the screws are apt to jam together and swing. This greatly affects the quality and effect of the glue spraying operation.
2. The pitch between the two conveying belts 12 is fixed and the positions of the two glue nozzles 30 are also fixed so that the glue spraying machine is only applicable to screws with a specific range of diameter and length.
3. The glue nozzles 30 directly spray the glue powder to the screws without previous stirring so that the glue powder can be hardly evenly sprayed onto the screws.

SUMMARY OF THE INVENTION

It is therefore a primary object of the present invention to provide an automatic glue spraying machine for screws, in which the rotary disk of the conveying device is formed with peripheral notches serving to space the screws from each other at equal intervals and stably convey the screws without jamming or swinging thereof. Therefore, the quality and effect of the glue spraying operation can be ensured.

It is a further object of the present invention to provide the above glue spraying machine in which a telescopic tube body supporting the glue sprayers is vertically adjustable according to the length of position of the screws and the rotary disk of the conveying device is replaceable with another rotary disk with peripheral notches suitable for the diameter of the screws so that the glue spraying machine is applicable to various diameters and lengths of screws.

It is still a further object of the present invention to provide the above glue spraying machine in which the main body of the glue sprayer is formed with an internal air chamber, whereby during glue spraying operation, a storm is created in the air chamber to previously evenly stir the glue powder and then evenly spray out the glue powder to the desired section of the screw. Therefore, a better glue spraying operation is achieved.

The present invention can be best understood through the following description and accompanying drawings, wherein:

DETAILED DESCRIPTION OF THE PREFERRED EMBODIMENT

Figure 2A:
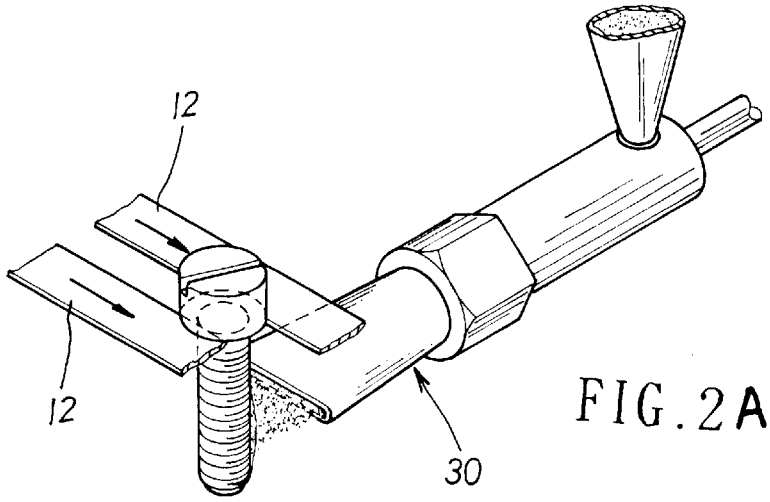
FIG. 2A PRIOR ART
FIG. 2A is a perspective view of FIG. 2.
Figure 2:
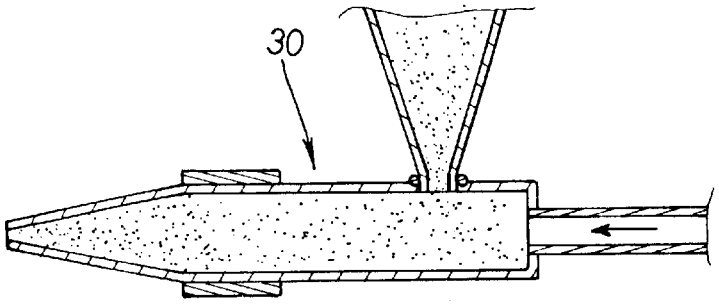
FIG. 2 PRIOR ART
FIG. 2 is an enlarged sectional view showing the glue spraying operation of the conventional glue spraying machine.
Figure 1:
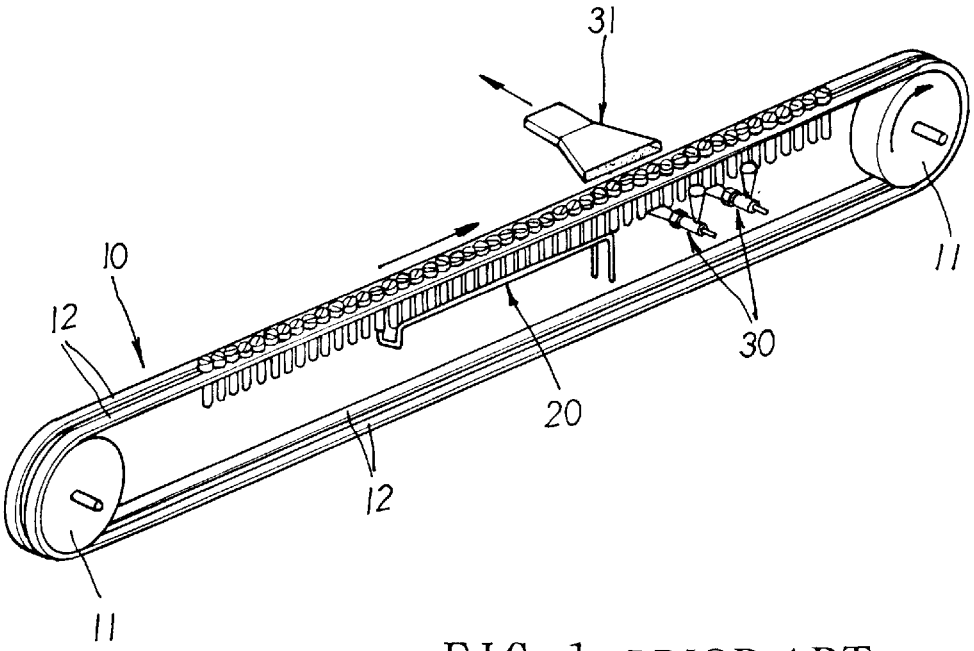
FIG. 1 PRIOR ART
FIG. 1 is a perspective view showing the screw conveying and glue spraying operation of a conventional glue spraying machine.
Figure 3:
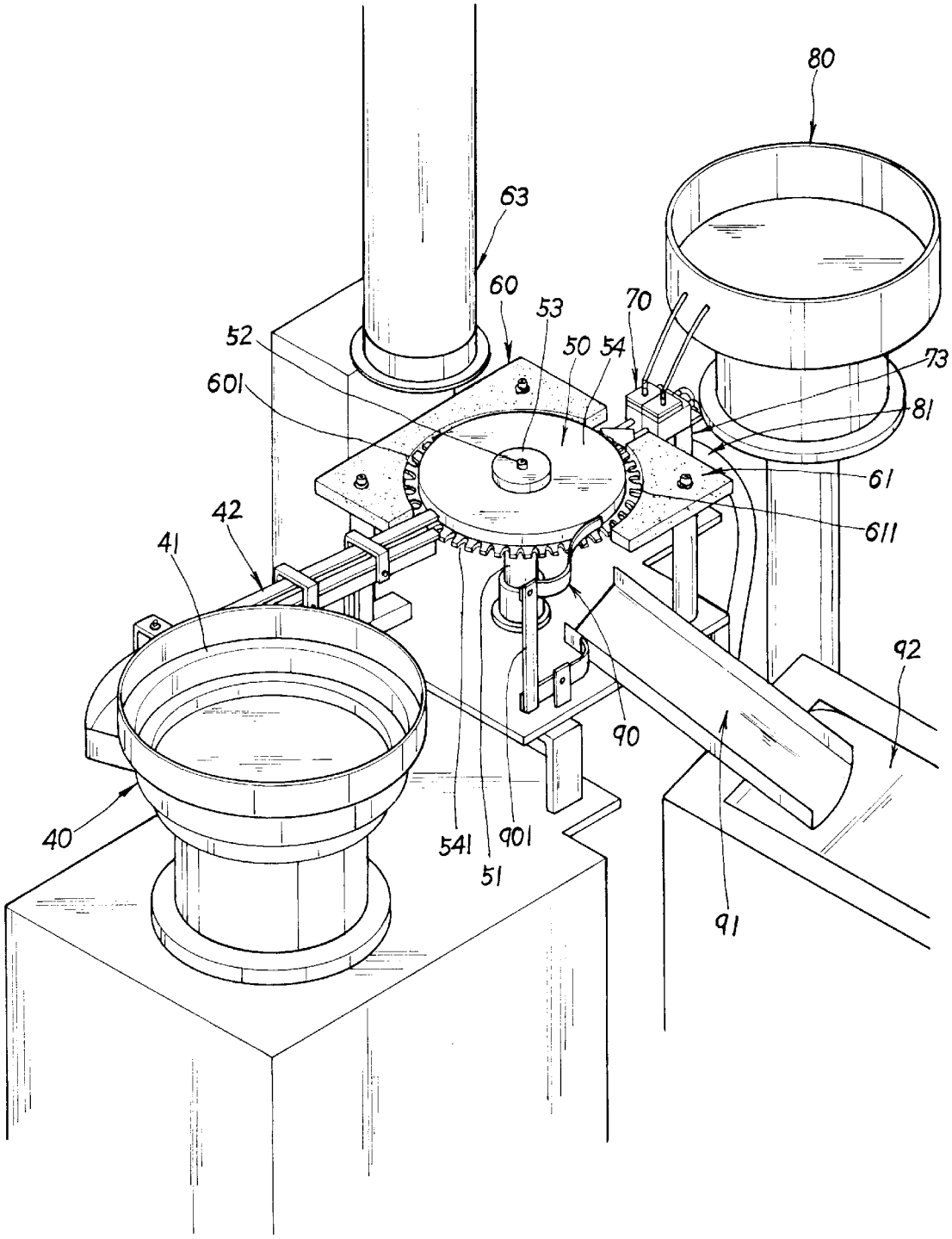
FIG. 3 is a perspective assembled view of the present invention.
Figure 4:
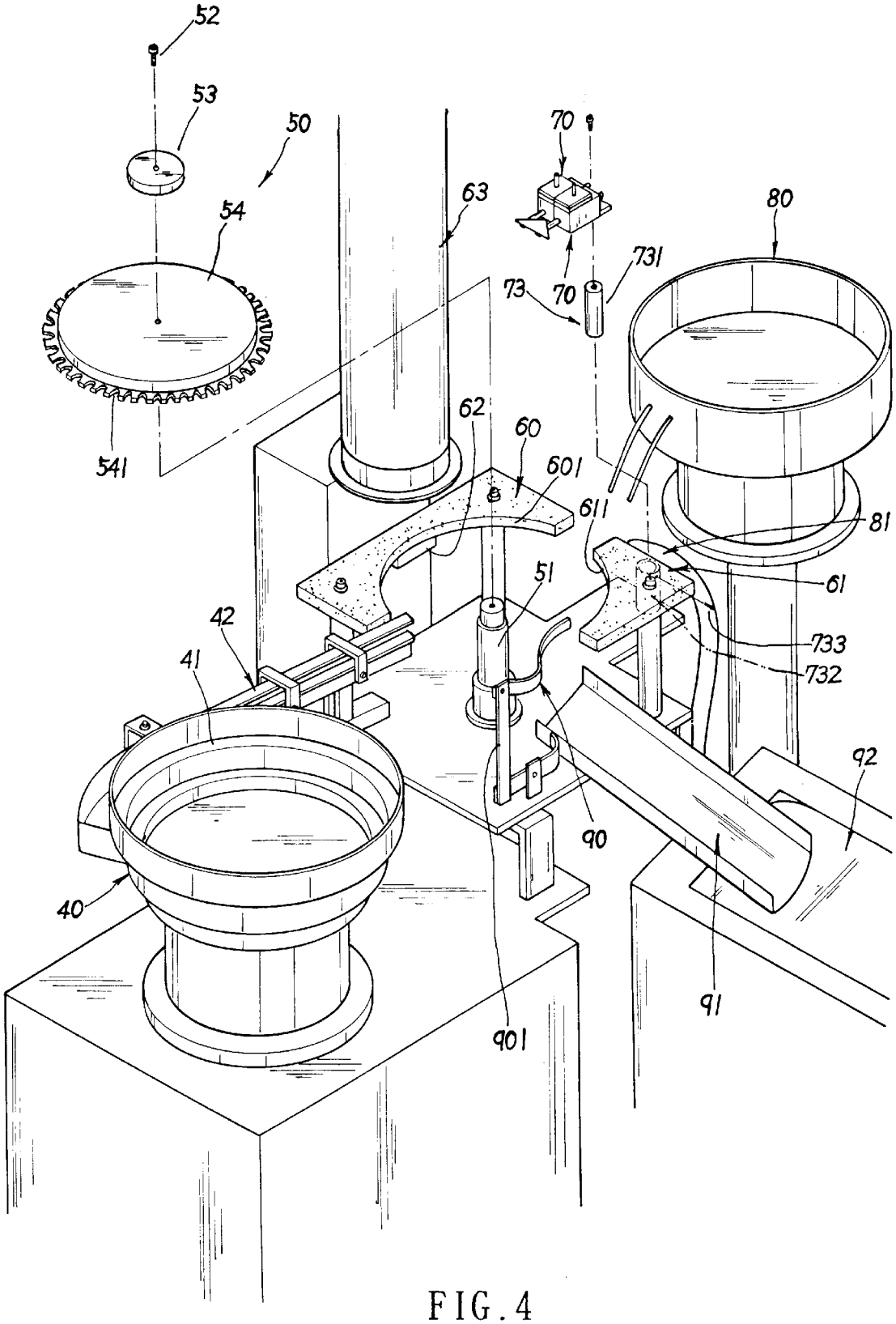
FIG. 4 is a perspective exploded view of the present invention.
Figure 5A:
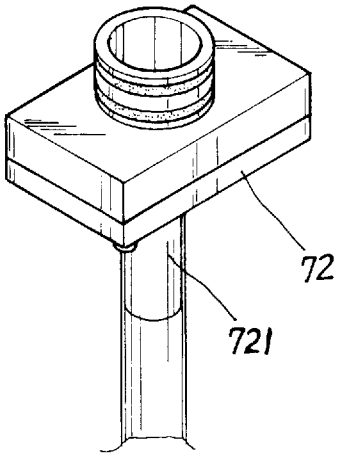
FIG. 5A is an upside-down placement of the glue powder feeding tube.
Figure 5B:
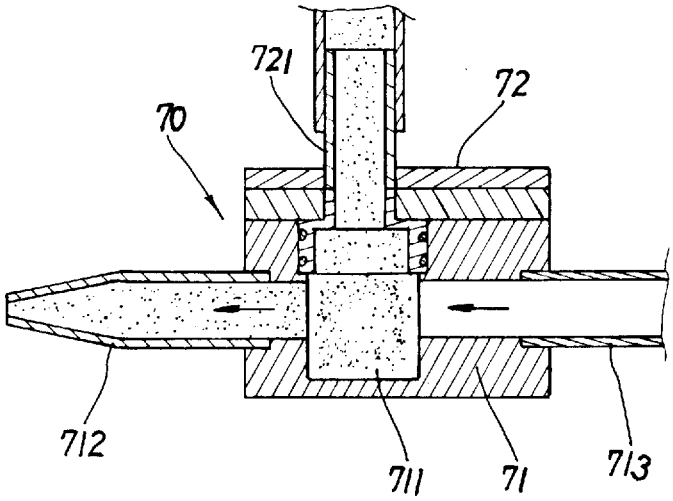
FIG. 5B is a sectional view of FIG. 5A, showing the operation mode thereof.
Figure 5:
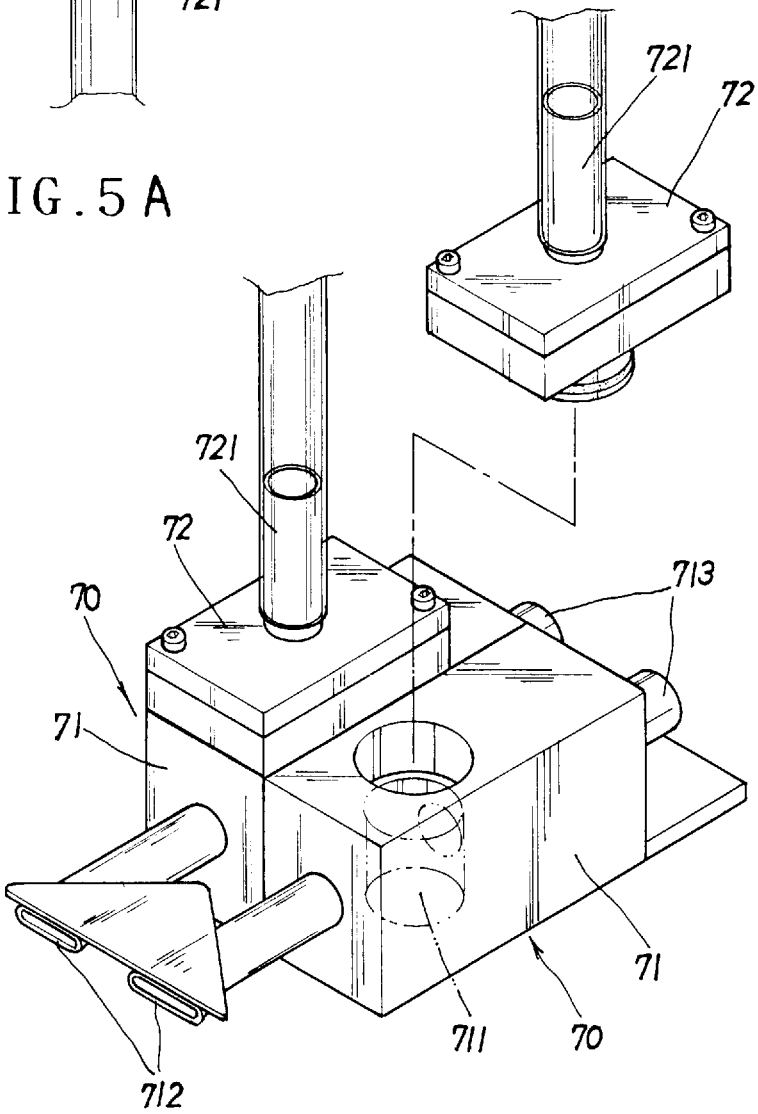
FIG. 5 is a sectional exploded view of the glue sprayer of the present invention, showing the glue spraying operation thereof.

Please refer to FIGS. 3 to 5. The glue spraying machine of the present invention includes a screw vibrator 40, a conveying device 50, a large asbestos board 60, a small asbestos board 61, a high frequency heater 62, an exhaustion radiating device 63, two glue sprayers 70, a glue powder vibrator 80, a glue powder recovering device 81, a resilient stopper plate 90, an arch inclined board 91 and a conveying belt 92. The inner wall of the screw vibrator 40 is formed with a spiral slope face 41. The end of the slope face 41 is connected with a guide way 42. The end of the guide way 42 is connected with a rotary disk 54 of the conveying device 50. The rotary disk 54 is secured on the top face of a rotary stem 51 by a fastening screw 52 and a cooperative circular pad member 53. The periphery of the rotary disk 54 is formed with multiple arch notches 541. The large asbestos board 60 is disposed on one side of the rotary disk 54. The middle section of inner edge of the large asbestos board 60 is disposed with a retaining arch edge 601 attached to an arch outer side of the rotary disk 54. The high frequency heater 62 is disposed under the large asbestos board 60. The exhaustion radiating device 63 is disposed above the large asbestos board 60. The small asbestos board 61 is disposed on the other side of the rotary disk 54. The inner edge of the small asbestos board 61 is disposed with a retaining arch edge 611 attached to an arch outer side of the rotary disk 54. The two glue sprayers 70 are supported between the large and small asbestos boards 60, 61 by a telescopic tube body 73 which includes an outer tube 732 and an inner tube 731 fitted in the outer tube 732. An inner hexagonal bolt 733 is passed through a thread hole of the outer tube 732 to abut against the outer wall of the inner tube 731 so as to fix the inner tube in the outer tube. Each glue sprayer 78 includes a main body 71 and an upper cap 72. The main body 71 is disposed with an internal air chamber 711. A nozzle 712 is disposed on the front face of the main body 71, while a blowing tube 713 is disposed on the back face thereof. The top face of the upper cap 72 is connected with a glue powder feeding tube 721 which is connected to the glue powder vibrator 80 by a connecting tube. The glue powder recovering device 81 is disposed under the glue sprayers 70. The resilient stopper plate 90 is disposed on another side of the rotary disk 54 and fixed by a supporting member 901. The arch inclined board 91 is disposed under the resilient stopper plate 90. The end of the inclined board 91 is connected with the conveying belt 92.

Figure 6:
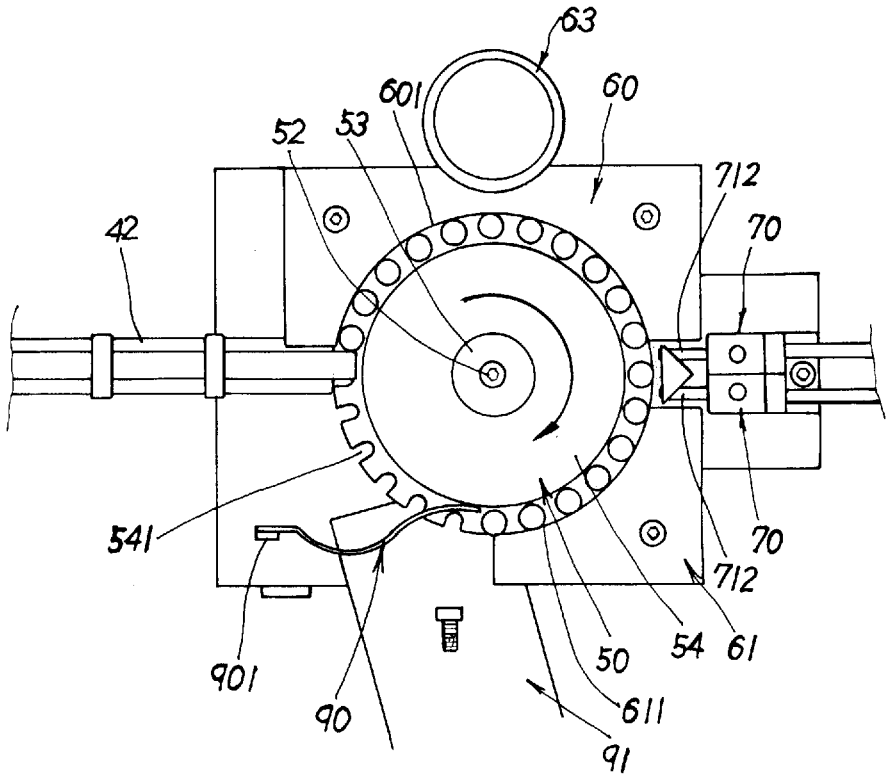
FIG. 6 is a top view showing the glue spraying operation of the present invention.

Referring to FIG. 6, during glue spraying operation, the screws to be glued are placed in the screw vibrator 40, whereby the screw vibrator 40 vibrates to upward move the screws along the spiral slope face 41 into the guide way 42. The guide way 42 serves to guide and advance the screws onto the rotary disk 54 one by one in such a manner that the head of the screw is hung on the upper end of the arch notch 541 of the rotary disk 54, while the stem of the screw is suspended from the lower side of the arch notch 541. When conveyed, the retaining arch edges 601, 611 of the large and small asbestos boards 60, 61 serve to keep the screws attached to the periphery of the rotary disk 54. After the screws are heated by the high frequency heater 62 to a predetermined temperature, a storm is created in the air chamber 711 of the main body 71 of the glue sprayer 70 during glue spraying operation (referring to FIG. 5). At this time, the glue powder is evenly sprayed out from the nozzles 712 to a predetermined section of the screw and the high temperature of the screw itself instantaneously melt the glue powder to adhere to the screw. After the glue spraying operation is completed, the excessive glue powder is recovered by the recovering device 81 under the nozzles 712. The glued screws are further conveyed by the rotary disk 54 and stopped by the stopper plate 90 to fall onto the arch inclined board 91. Then the screws slide downward onto the conveying belt 92 to be conveyed and cooled.

Figure 7:
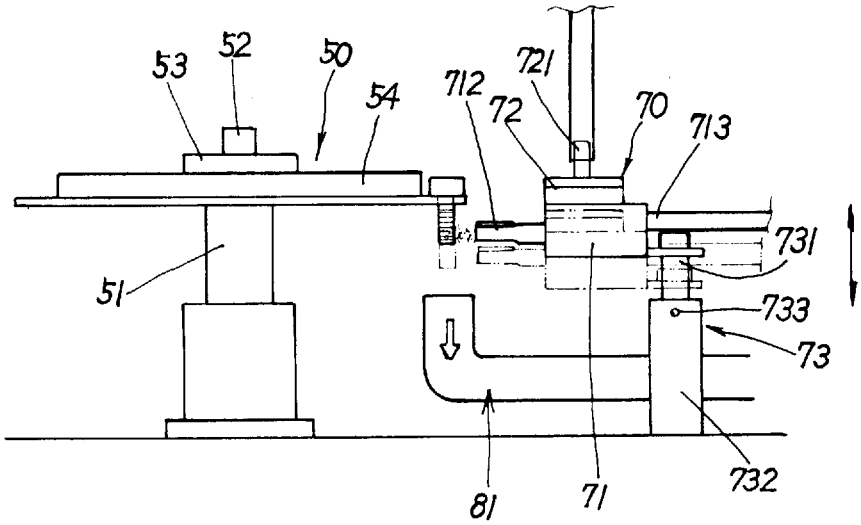
FIG. 7 is a side view showing the vertical adjustment of the sprayers of the present invention.

FIG. 7 shows the adjustment of the position of the sprayers. In the case that the length or position of the screw to be glued is changed, the inner hexagonal bolt 733 is untightened, permitting the inner tube 731 of the telescopic tube body 73 to be moved vertically to a desired height. Then the bolt 733 is again tightened to fix the nozzles 712 at a position in alignment with the right section of the screw. On the other hand, in the case that the diameter of the screw to be glued is changed, the fastening screw 52 of the conveying device 50 is untightened and the circular pad body 53 is removed to replace the rotary disk 54 with another rotary disk with arch notches 541 dimensionally suitable for the screws. Therefore, the screws can be snugly fitted in the arch notches 541 of the rotary disk 54.

According to the above arrangements, the present invention has the following advantages:

1. The rotary disk 54 of the conveying device 50 is able to space the screws from each other at equal intervals and is able to stably convey the screws without jamming or swinging thereof. Therefore, the quality and effect of the glue spraying operation can be ensured.
2. The telescopic tube body 73 supporting the glue sprayers 70 is vertically adjustable and the rotary disk 54 of the conveying device 50 is replaceable so that the present invention is applicable to various diameters and lengths of screws.
3. During glue spraying operation, the storm created in the air chamber 711 of the main body 71 of the sprayer 70 serves to previously evenly stir the glue powder and then evenly spray out the glue powder to the desired section of the screw. Therefore, a better glue spraying operation is achieved.

The above embodiment is only an example of the present invention and the scope of the present invention should not be limited to the example. Any modification or variation derived from the example should fall within the scope of the present invention.

What is claimed is:

1. An automating glue spraying machine for screws, compressing a screw vibrator, a conveying device including a rotary disk, a large asbestos board, a small asbestos board, a high frequency heater disposed under the large asbestos board, an exhaustion radiating device disposed above the large asbestos board, two glue sprayers, a glue powder vibrator, a glue powder recovering device disposed under the glue sprayers, a resilient stopper plate disposed on one side of the conveying device, an arch inclined board disposed between the conveying board and a conveying belt, wherein during a glue spraying operation, the screws to be glued are placed in the screw vibrator, whereby the screw vibrator vibrates to upwardly move the screws along an inner spiral slope face of the screw vibrator into a guide way, the guide way serving to guide and advance the screws to be conveying device, when conveyed, inner retaining arch edges of the large and small asbestos boards serving to keep the screws attached to outer periphery of the rotary disk, after the screws being heated by the high frequency heater to a predetermined temperature, the glue powder is evenly sprayed out from the nozzles of the glue sprayers to a predetermined section of the screw and the high temperature of the screw itself instantaneously melt the glue powder to adhere to the screw, after the glue spraying operation being completed, the excessive glue powder is recovered by the recovering device under the nozzles, the glued screws being further conveyed by the rotary disk and stopped by the stopper plate to fall onto the arch inclined board, then the screws sliding downward onto the conveying belt to be conveyed and cooled, said glue spraying machine being characterized in that:

the rotary disk is secured on the top face of a rotary stem by a fastening screw and a cooperative circular pad member, the periphery of the rotary disk being formed with multiple arch notches, the two glue sprayers being supported between the large and small asbestos boards by a telescopic tube body which includes an outer tube and an inner tube fitted in the outer tube, an inner hexagonal bolt being passed through a thread hole of the outer tube to abut against the outer wall of the inner tube so as to fix the inner tube in the outer tube, each glue sprayer including a main body and an upper cap, the main body being disposed with an internal air chamber, a nozzle being disposed on the front face of the main body, while a blowing tube being disposed on the back face thereof, the top face of the upper cap being connected with a glue powder feeding tube which is connected to the glue powder vibrator, the rotary disk of the conveying device being able to space the screws from each other at equal intervals and being able to stably convey the screws without jamming or swinging thereof, during glue spraying operation, a storm being created in the air chamber of the main body of the sprayer to previously evenly stir the glue powder and then evenly spraying out the glue powder to the desired section of the screw so as to achieve a better glue spraying operation.

2. A glue spraying machine as claimed in claim 1, wherein in the case that the length or position of the screw to be glued is changed, the inner tube of the telescope tube body can be manually moved vertically within the outer tube to a desired height so that the sprayers can be moved to a position in alignment with the right section of the screw.

3. A glue spraying machine as claimed in claim 1, wherein in the case that the diameter of the screw to be glued is changed, the rotary disk of the conveying device can be manually replaced with another rotary disk with arch notches dimensionally suitable for the screws.

* * * * *